US010595600B2

(12) United States Patent
Stein

(10) Patent No.: US 10,595,600 B2
(45) Date of Patent: Mar. 24, 2020

(54) INVERTIBLE ORNAMENTAL CHARMS

(71) Applicant: Loren W. Stein, Boca Raton, FL (US)

(72) Inventor: Loren W. Stein, Boca Raton, FL (US)

( * ) Notice: Subject to any disclaimer, the term of this patent is extended or adjusted under 35 U.S.C. 154(b) by 0 days.

(21) Appl. No.: 16/144,988

(22) Filed: Sep. 27, 2018

(65) Prior Publication Data

US 2019/0098970 A1 Apr. 4, 2019

Related U.S. Application Data

(60) Provisional application No. 62/565,452, filed on Sep. 29, 2017.

(51) Int. Cl.

| | |
|---|---|
| ***A44C 15/00*** | (2006.01) |
| ***A44C 25/00*** | (2006.01) |
| *A44C 5/00* | (2006.01) |

(52) U.S. Cl.

CPC ..... *A44C 25/007* (2013.01); *A44C 25/001* (2013.01); *A44C 5/0007* (2013.01); *A44C 15/005* (2013.01)

(58) Field of Classification Search

CPC . A44C 15/0025; A44C 25/001; A44C 25/007; A44C 3/004; A44C 3/008; A44C 17/0208; A44C 17/0241; A44C 25/00; A44C 25/002; A44C 25/004; A44C 5/185; A44C 15/00; A44C 5/084; A44C 5/0084; A44C 17/0025; A44C 17/025

USPC .... 63/21, 23, 40, 31, 18, 38, 41, 13; D11/6, D11/7–10, 79, 97–98

See application file for complete search history.

(56) References Cited

U.S. PATENT DOCUMENTS

| | | | | |
|---|---|---|---|---|
| 7,007,507 | B2 | 3/2006 | Enevoldsen | |
| 2004/0129022 | A1* | 7/2004 | Chien | A44C 9/0053 63/1.11 |

OTHER PUBLICATIONS

Storenvy.com Listing: Sep. 28, 2018 Offcell Double-Sided Charms: http://ohnips.storenvy.com/collections/906486-offcell/products/16605363-offcell-double-sided-charms.

Artbeads.com Listing: Sep. 28, 2018 Antique Sterling Silver Double-Sided Seahorse Charm: https://www.artbeads.com/jewelry-supplies/antique-sterling-silver-double-sided-seahorse-charm-charm-4288/#.

Amazon.com Listing: Jun. 1, 2018 200 Top Quality Leaf Charms Connectors 27mm Two-Sided Antique Bronze for Jewelry Making CF137: https://www.amazon.com/Quality-Connectors-Two-Sided-Antique-Jewelry/dp/B07DHW8C9B/ref=sr_1_2_sspa?s=arts-crafts&ie=UTF8&qid=1538073606&sr=1-2-spons&keywords=two+sided+charm&psc=1.

(Continued)

*Primary Examiner* — Jack W Lavinder
(74) *Attorney, Agent, or Firm* — Sriplaw, P.A.

(57) ABSTRACT

A jewelry apparatus comprises a chain and a decorative element having an opening disposed along an axis for slidably receiving the chain. The decorative element comprises a first portion, a second portion and at least two supporting members. The second portion is spaced in relation to the first portion on opposed sides of the opening. A first ornamental surface and a second ornamental surface are disposed in opposed outwardly facing directions relative to each other along a transverse axis. The two supporting members connect the first and second portions and are disposed on opposed sides of the longitudinal opening. The decorative element is free to rotate about the longitudinal axis between a first position in which the first ornamental surface faces outwardly from the user when worn by the user and a second position in which the second ornamental surface faces outwardly from the user.

20 Claims, 6 Drawing Sheets

(56) References Cited

OTHER PUBLICATIONS

Etsy.com Listing: Dec. 28, 2016 Reversible Custom Vertical Gold Bar Necklace-Personalized Nameplate/Date Skinny Long Bar-Reversible-14K Gold Filled-Rose-Silver—CG231N: https://www.etsy.com/listing/488050389/reversible-custom-vertical-gold-bar?gpla=1&gao=1&&gclid=Cj0KCQjw_7HdBRDPARIsAN_ItcK0NCE51qx6loSGI-cs7LVetwarmFGIFPvKUlu5ISiEf8JFzo7BdPsaAk9nEALw_wcB.
Julievos.com Listing: Aug. 21, 2017 Valencia Double Sided Pendant: https://www.julievos.com/products/valencia-double-sided-pendant-1.
Alexandani.com Lising: Sep. 28, 2018 Meditating Eye Color Infusion Expandable Necklace | David Lynch Foundation: https://www.alexandani.com/meditating-eye-color-infusion-necklace-cbd17mensg.html.
Bluenile.com Listing: Sep. 28, 2018 Victorian Spinning Locket: https://www.bluenile.com/sterling-silver-victorian-spinning-locket_23592?elem=img&track=product&vtype=sample.
Notonthehighstreet.com Listing: Dec. 31, 2014 https://www.notonthehighstreet.com/soremi/product/personalised-silver-spinner-pendant.

* cited by examiner

INVERTIBLE ORNAMENTAL CHARMS

CROSS REFERENCE TO RELATED APPLICATION

This application claims priority to U.S. Provisional Application Ser. No. 62/565,452, filed Sep. 29, 2017, which is incorporated by reference herein.

BACKGROUND OF THE INVENTION

The present disclosure relates generally to jewelry and, more particularly, to invertible decorative elements, more commonly known as invertible charms, or "flip charms," which are typically strung on a chain worn by a user around a neck, wrist, ankle or other body part and which further have two faces and do not use bails or jump rings to attach to chains.

Charms, also called pendants, are known, and are generally connected to chains via visible bails, jump rings or other loop-type structures that are attached to the charm and which allows the chain to be threaded through the loop such that the charm hangs from the chain. However, charms equipped with these linkages have a tendency to flip horizontally, or twist about-face, thereby rotating along a vertical axis, so that the back face is showing rather than the ornamental front face. One possible solution to this flipping problem is to use two bails in a "rabbit ear" configuration, where the bails are connected to the top or back of the charm and are spread apart at a distance. While this approach lessens the occurrence of flipping, the bails must still be of an appropriate size to clear the chain's clasp. The bails are also visible components of the jewelry, which is less desirable as bails generally do not contribute to the overall design of the charm. The ring 4 or bail 5 also may be appropriately sized to be larger than the diameter chain but smaller than the clasp of the chain which prevents the charm from being removed from the chain and/or allow interchangeability with other charms without breaking or severing the ring 4 or bail 5.

Accordingly, it would be advantageous to manufacture a slideable charm that does not have visible bails or jump rings and has two ornamental surfaces so that in the event the charm flips, an ornamental surface is always visible. It is also advantageous to provide one or more charms which may be independently flipped vertically or rotate along a horizontal axis between two ornamental surfaces, and may be individually assembled or interchanged on a chain to provide a multitude of different design combinations.

BRIEF SUMMARY OF THE INVENTION

In one aspect, the present disclosure includes a jewelry apparatus wearable by a user. The jewelry apparatus comprises a jewelry chain and a decorative element having a longitudinal opening disposed along a longitudinal axis for slidably receiving the chain. In another aspect, the present disclosure may also be directed to one decorative element, or a plurality of decorative elements, having one or more of the features described herein.

The decorative element comprises a first portion, a second portion and at least two supporting members. The first portion has a first ornamental surface and a first opposing surface which is opposed to the first ornamental surface. The second portion has a second ornamental surface and a second opposing surface which is opposed to the second ornamental surface. The second portion is transversely spaced in relation to the first portion on opposed sides of the longitudinal opening. The first ornamental surface and the second ornamental surface are disposed in opposed outwardly facing directions relative to each other along a transverse axis that is perpendicular to the longitudinal axis. The at least two supporting members transversely extend between the first portion and the second portion and connect therebetween. A first supporting member and a second supporting member are disposed on opposed sides of the longitudinal opening. The decorative element is free to rotate about the longitudinal axis between a first position in which the first ornamental surface faces outwardly from the user when worn by the user and a second position in which the second ornamental surface faces outwardly from the user. Additional aspects may also be apparent from the present disclosure.

BRIEF DESCRIPTION OF THE DRAWINGS

The following description of the disclosure will be better understood when read in conjunction with the appended drawings. For the purpose of illustrating the disclosure, there are shown in the drawings embodiments of a charm which is presently preferred. It should be understood, however, that the disclosure is not limited to the precise arrangements and instrumentalities shown. In the drawings.

DESCRIPTION OF THE DISCLOSURE

Figure 1:
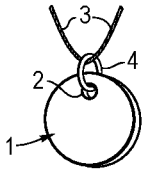
FIG. 1 is a front isometric view of a prior art charm with a jump ring attached via a drilled hole in the charm.
Figure 2:
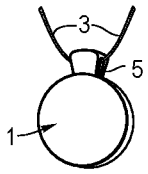
PRIOR ART FIG. 2
FIG. 2 is a front isometric view of a prior art charm with a top soldered bail attached.

Certain terminology is used in the following description for convenience only and is not limiting. The words "lower," "bottom," "upper" and "top," "front," "rear," "behind," "forward," "rearward," "rightward," "rightmost," "leftward," "leftmost," "horizontal," "vertical" and so on designate directions in the drawings to which reference is made. The words "inwardly," "outwardly," "upwardly" and "downwardly" refer to directions toward and away from, respectively, the geometric center of the charm, and designated parts thereof, or, where otherwise indicated, from the user, in accordance with the present disclosure. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

As used herein, the terms "longitudinal" "lateral" and "transverse" refer to each one of the three axes of direction in three-dimensional space (i.e., a longitudinal axis, a lateral axis and a transverse axis) which may also be referred to in a XYZ coordinate system as an X-axis, a Y-axis and a Z-axis. It is generally understood that each axis is perpendicular to the other two (i.e., the longitudinal axis is perpendicular to the lateral and transverse axes and so on). The term that refers to a particular axis is arbitrary as these terms may be used interchangeably or substituted without departing from the scope of the present disclosure. For example, these axes are not limited to the horizontal, vertical or other spatial orientations shown in the drawings, and any reference to such orientation is merely by example and not limitation.

Figure 3:
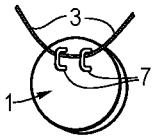
PRIOR ART FIG. 3
FIG. 3 is a rear isometric view of a prior art charm with a "rabbit ear" configuration.
Figure 4:
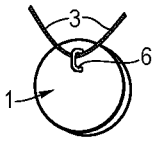
PRIOR ART FIG. 4
FIG. 4 is a rear isometric view of a prior art charm with a bail soldered to the back face.

Referring to the drawings in detail, wherein like numerals indicate like elements throughout, there is shown in FIGS. 1-4 different embodiments of the prior art. Conventional charms, generally designated 1, typically have either spring or jump rings 4 or bails 5 attached to the charm 1 through a drilled hole 2. The chains 3 slide through the spring rings 4 or bails 5 and allow a person to wear the charm 1 around their neck or wrist. As shown in FIGS. 3 and 4, rings 6, 7 may be soldered onto the back of the charm 1 to obviate the need to drill a hole 2 in the charm itself. Rings 6, 7 may be soldered onto the back of the charm in either a single or "rabbit ear" configuration whereby the "rabbit ear" configuration leads to increased stability of the charm 1 on the chain 3. It is the tendency of such prior art charms to flip or rotate horizontally, whereby the charm 1 rotates about a vertical axis, resulting in the back/rear of the charm is facing outwardly from the user/wearer.

There is shown in FIGS. 5-12 on a chain 10, multiple styles of decorative elements (conventionally know as charms or pendants), generally designated 20, 120, 220, 320, 420, et seq., in accordance with embodiments of the present invention that are presently preferred. As multiple embodiments of decorative elements will be shown and described, a similar numbering convention will be used for like parts, in which the last two digits for identical, similar or comparable parts will be identical and even where not specifically recited or labeled on the figures. Thus, all parts numbers for one embodiment shall apply to all subsequent embodiments having comparable parts.

Figure 5:
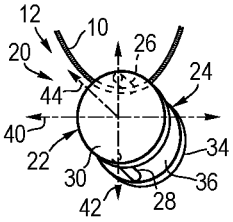
PRIOR ART FIG. 5
FIG. 5 is a front isometric view of a decorative element or charm according to a first embodiment of the present invention, having the same shaped ornamentation on the front and back surfaces.

Turning first to FIG. 5, a jewelry apparatus, generally at 12, includes a decorative element, generally at 20, which comprises a first portion, generally at 22, a second portion, generally at 24, which is spaced from the first portion 22. Two supporting members 26, 28 connecting the first and second portions, 22, 24, on opposed sides of the longitudinal opening 38 in a direction generally perpendicular to the first and second portions spacing, as shown best in FIG. 9A. The first portion 22 has a first ornamental surface 30 and a first opposing surface 32 which is opposed to the first ornamental surface. Similarly, the second portion 24 also respectively includes a second ornamental surface 34 and a second opposing surface 36.

Figure 9A:
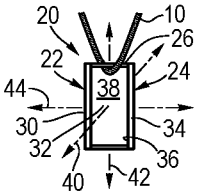
FIGS. 9A-9C are side elevational views of the embodiments of FIGS. 5-7A, respectively.
Figure 9B:
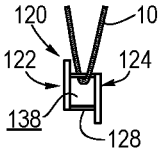
Figure 9C:
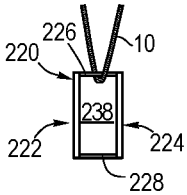
Figure 9D:
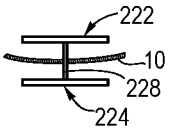
FIG. 9D is a bottom plan view of the embodiment of FIGS. 7A and 7B.
Figure 9E:
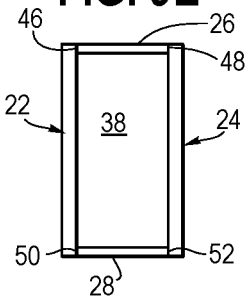
FIG. 9E is an enlarged view of the embodiment of FIG. 9A.

In FIG. 9A, the first and second portions 22, 24 are spaced relative to each other on opposed sides of a longitudinal opening 38 which slidably receives the chain 10. With reference to FIG. 5, the longitudinal opening is shown extending along a longitudinal axis 40, which in FIG. 5 is generally shown along a horizontal axis or direction, although this horizontal direction is shown for example and not limitation. A lateral axis 42 is perpendicular to the longitudinal axis, which in FIG. 5 is generally shown along a vertical axis or direction although, similarly, this is for example and not limitation. As shown in FIG. 9A, a transverse axis 44 is perpendicular to the longitudinal and lateral axes 40, 42 and generally extends outward from the plane defined by the longitudinal and lateral axes (as both shown in FIG. 5). As shown in FIGS. 9A and 9E, the first and second portions 22, 24 are spaced in relation to each other along the transverse axis 44 and located on opposite sides of the longitudinal opening 38. In FIG. 9E, the first and second portion 22, 24 are shown as generally planar and parallel to a longitudinal/lateral disposed plane, although other configuration are also possible.

In FIG. 5, a first position of the decorative element includes that the first ornamental surface 30 faces outwardly in one direction, which, is shown by way of example, facing front or forwardly in the view shown in FIG. 5, while the second ornamental surface 34 faces outwardly in an opposite direction to the first ornamental surface, or to the back or rearwardly of the view shown in FIG. 5. In this way, the first and second ornamental surfaces are disposed in opposed outwardly facing directions relative to each other. By way of convention in FIG. 5, the first ornamental surface 30 faces away from a user (not shown) wearing the jewelry apparatus when in a first position so that the first ornamental surface is facing outward for unobstructed viewing. As discussed further herein, a second position of the decorative element, which occurs after rotation of 180 about the longitudinal axis 40 (which may also be hereinafter also defined as vertical flipping of the decorative element) includes where the relative positions of the first and second ornamental surfaces has switched, or where the second ornamental surface faces away from the user/wearer and the first ornamental surface faces towards the user/wearer.

As viewed in FIG. 9A, the first opposing surface 32 faces inwardly and the second opposing surface 36 is also directed inwardly and faces the first opposing surface 32. In fact, in FIG. 9A, the first and second opposing surface are disposed in facing relation to each other on opposing sides of the longitudinal opening. It is appreciated that the first and second portions while being shown as having generally planar surfaces may also be formed as multi-planar or other three-dimensional configurations or designs. Moreover, while the first and second portion are shown as generally parallel to each other, these portions may assume other configurations so long as there are spaced from each other and are generally disposed on opposed sides of the longitudinal opening.

It is contemplated that the first and second portion may have a myriad of shapes and configurations as desired, such as but not limited to the shapes shown in the accompanying drawings and described herein. Accordingly, it is understood that the shapes shown and described are shown as examples and the present disclosure is not limited to these representations. By way of example and not limitation, in FIG. 6, another embodiment of a decorative element, generally at 120, is shown with like sequential numbered parts, including a first portion 122 and a second portion 124 having a triangle shape, wherein a first portion 122 (located in the front in FIG. 6) has an upright configuration when it is disposed in a first position, while a second portion 124 (towards the rear in FIG. 6) has an inverted configuration. When the decorative element 120 rotates around the longitudinal axis about the chain (via a vertical flip), the inverted second portion 124 moves to a second position, whereby the second portion is now in an upright orientation and has switched positions with the first portion 122, which, in rotating or vertical turning about the longitudinal axis, assumes an inverted orientation.

Figure 7A:
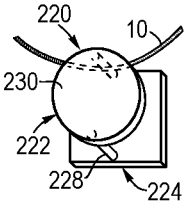
FIG. 7A is a front isometric view of a decorative element or charm according to a third embodiment of the present invention, having different shaped ornamentations on the front and rear surfaces, respectively.
Figure 7B:
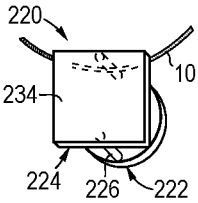
FIG. 7B is a rear isometric view of the charm of FIG. 7A, in which the front and rear decorative elements or charms have vertically flipped or rotated about a longitudinal or horizontal axis.

Similarly, in FIGS. 7A-7B, a further embodiment of a decorative element, generally at 220, is shown with like sequential numbered parts, including a first portion 222 having a circular shape and a second portion 224 having a square shape. It is understood that the first and second portions may be different shapes from each other to provide a myriad of combinations of styles as desired. Other shapes and configurations are also possible in addition to those described and shown herein. FIG. 7A illustrates a first position in which the first portion 222 having a circular shape is located in front, while the second portion 224 is located rearwardly. When the decorative element 220 rotates around the longitudinal axis about the chain (via a vertical flip) to a second position, the second portion has switched positions with the first portion 122 to be in front. Since the first and second portions 222, 224 have horizontally symmetrical shapes, the orientation of each shape still appears uprights, but it is understood that the shapes have vertically flipped when moved between the first and second positions.

As shown in FIGS. 8A-8D, 10A-10C and 11A-11G, the chain 10 is capable of sliding freely in either direction along the longitudinal opening 38, 138, 238, which is defined between the first and second portions 22, 24, 122, 124, 222, 224 of the decorative element 20, 120, 220 and the supporting members 26, 126, 226. As shown in FIGS. 5-8C and 9A-9D, the first supporting member 26, 126, 226 sits on the chain 10 when in the first position, and the second supporting member, which is shown by way of example at 228 in FIG. 8D, sits on the chain 10 when in the second position.

There may be a plurality of supporting members. By way of example and not limitation, FIG. 5-11G shows two supporting members, although additional supporting members may be employed as described further below. Relative to FIGS. 5-11G, there are at least two supporting members, 26, 28, 126, 128, 226, 228 with a first supporting member 26, 126, 226 that is located close to the top of the decorative element (for example, in the front and side views shown in FIGS. 8A-8C and 9A-9C) and a second support member that is located close to the bottom of the decorative element. The first and second supporting members are laterally spaced or separated (which is shown by way of example as vertically spaced in FIGS. 8A-8D, 9A-9C) from each other (relative to lateral axis 42, shown by way of example in FIG. 9A) and disposed on opposed sides of the longitudinally opening 38, 138, 238. As shown by way of example in FIGS. 9A and 9E, the supporting members 26, 28 are laterally spaced with respect to each other and disposed in corresponding longitudinal/transverse planes, which are perpendicular to the first and second portions 22, 24. As also in the view of FIG. 9E, each supporting member 26, 28 has two corresponding ends, a first end 46, 50, and a second end 48, 52, which attached respectively to the first portion 22 and the second portion 24. Variations in the number and configuration of supporting members are also possible and these will depend on the particular geometric shape or outline of the first and second portions, as will be discussed herein.

This configuration allows for the decorative element or charm 20, 120, 220 to flip on the chain 10 so that either ornamental surface may be visible, when worn by a user. By way of illustration, FIGS. 7A and 7B, where the first and second portions have different shapes, the decorative element 222 may rotate about the longitudinal axis, or vertically flip, between the first position (in which the first portion 222 faces away from the user) and the second position (in which the second portion 224 faces away from the user). In FIG. 7A, the first portion 222 with a circle shape is shown in the first position where the first ornamental surface 230 faces front while the second portion 224 having a square shape is shown in the rear (and the second ornamental surface 234 faces rearwardly). After rotation or vertical flipping of the decorative element 222 to a second position, the second portion 224 having a square shape is shown in front, with its ornamental surface 34 (which is also shown having an engraving or other indicia 260 which may be employed on any of the embodiments shown and described herein) facing forwardly while the first ornamental surface then faces rearwardly.

As shown, there is no "wrong" side of the charm 20, et seq., and "flipping" is encouraged. More specifically, the decorative element is free to rotate about the longitudinal axis between a first position in which the first ornamental surface faces outwardly from the user when worn by the user and a second position in which the second ornamental surface faces outwardly from the user. There may be a plurality of decorative elements or charms as desired by the user. The charms 20 may even be stacked, compressed or overlapping to allow for a layered effect as seen in FIGS. 10A-10C, 11B, 11G, or they may be touching each other without overlapping as seen in FIGS. 11D, 11E, 11F, or there may be some combination thereof as seen in FIG. 11A or FIG. 11C.

Figure 6:
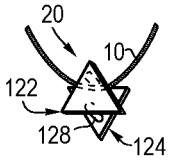
FIG. 6 is a front isometric view of a decorative element or charm according to a second embodiment of the present invention, having the same shaped ornamentation on the front and back charm surfaces, wherein the ornamentation on the back surface is inverted relative to the ornamentation on the front surface.
Figure 8A:
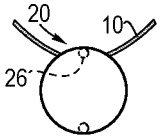
FIGS. 8A-8D are front elevational views of the embodiments of FIGS. 5-7B, respectively.
Figure 8B:
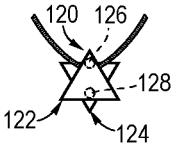
Figure 8C:
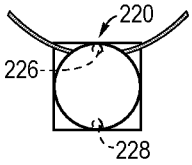

It is understood that either ornamental surface may take the form of a variety of shapes. In one embodiment, the first and second ornamental surfaces may be the same shape (FIGS. 5, 8A, 9A, 10A, 10B, 11D, 11G) such as a circularly shaped decorative element 20 or a triangularly shaped decorative element 320 (which will be referred to as an "upright compound configuration"). In an alternative embodiment, the decorative element 120 may have first and second ornamental surfaces that may be inversions of the same shape. In FIGS. 6, 8B, 9B, the shapes are horizontally asymmetrical and are attached to each other so that in either one of the first and second positions, the rearwardly located shaped is inverted relative to the forward shape—which will be referred to as an "inverted compound configuration"). More particularly, in a first position, the first portion is forwardly located in an upright orientation and the second portion is rearwardly located in an inverted orientation of the same shape, and then after rotation of 180 degrees, or vertical flipping, of the decorative element to a second position, the first portion is moved to a rearward inverted orientation and the second portion is moved forwardly upright orientation.

In another embodiment, the decorative element 220 may have first and second ornamental surfaces that may be different shapes (such as the circular and squarish shapes shown in FIGS. 7A, 7B, 8C, 8D, 9C, 10C) that have horizontal geometric symmetry (which may be referred to herein as an "upright complex configuration"). After rotation of the shape to a rearward orientation, the horizontal symmetry allows the shapes to appear upright even though the shape has been vertically flipped. Although not specifically described or shown, it is contemplated that the first and second portions of the decorative element may also be comprised of different ornamental surfaces shapes which are also horizontally geometrically asymmetrical (which may be referred to as an "inverted complex configuration") as well as shapes having other types of asymmetry but attached in such a way so that the forwardly located shape is still viewed in an upright orientation.

Figure 8D:
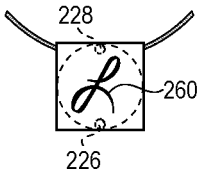
Figure 11A:
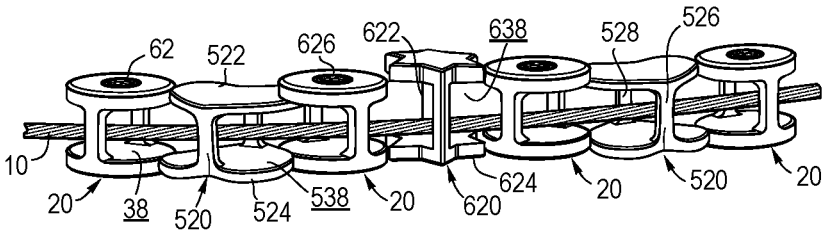
FIGS. 11A-11G illustrate exemplary embodiments of charms according to the present invention, in the form of bracelets, necklaces or studs.
Figure 11B:
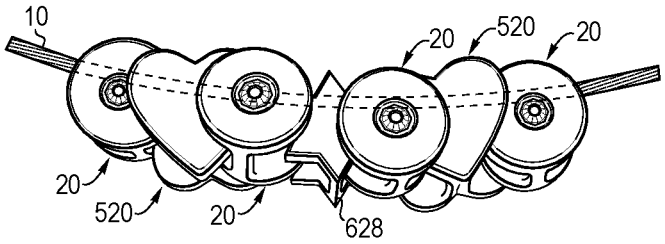
Figure 11C:
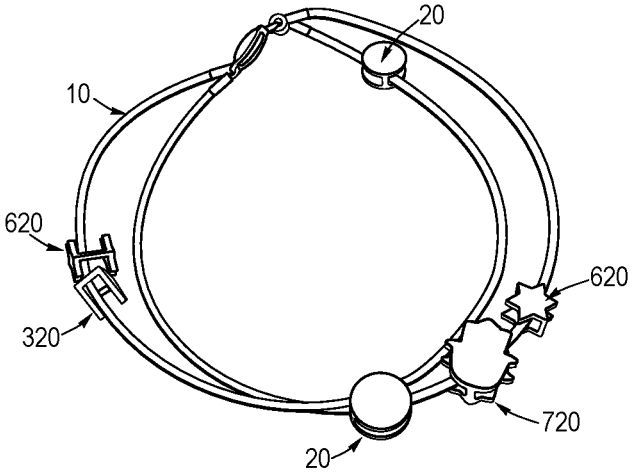
Figure 11D:
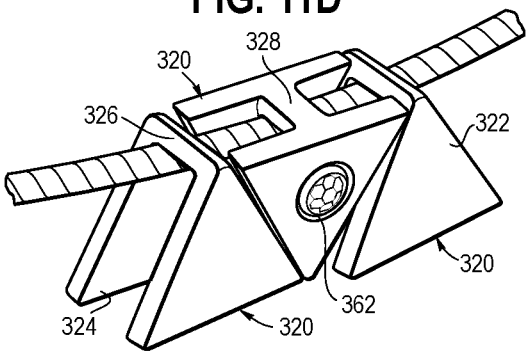
Figure 11E:
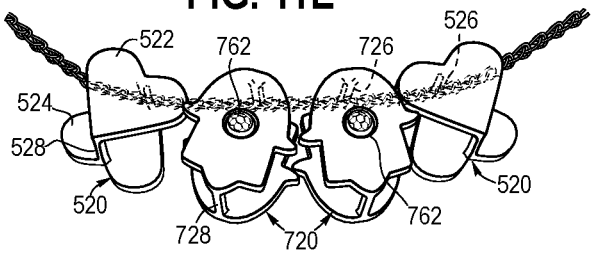
Figure 11F:
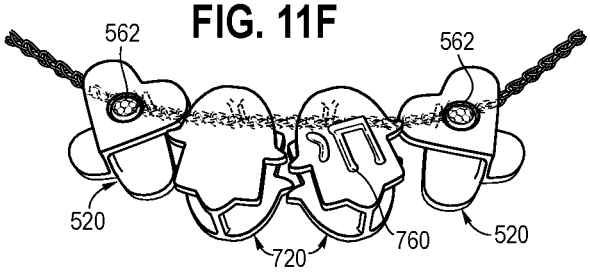
Figure 11G:
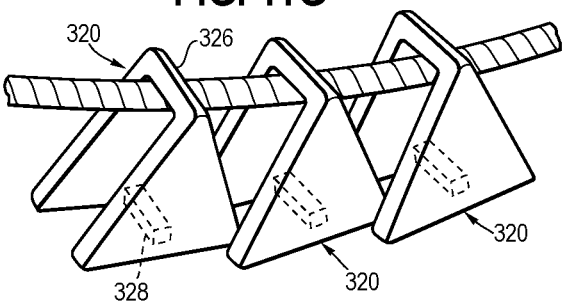

In addition, the first or second ornamental surfaces may be embellished with engravings or monograms 260, 760 as shown in FIGS. 8D, 11E-11F, stones, gemstones or other adornments 62, 362, 762, as shown in FIGS. 11A, 11B, 11D, 11E, 11F or any other form of embellishments which may located either in the center of the ornamental surfaces, as shown in FIGS. 11A, 11B, 11D, 11E, 11F, or at other locations, or on any of the ornamental or opposing surfaces in FIGS. 18A, 19A, 20A, 20B, 21A, 22A, 23, where such surface may be viewed when facing outwardly from the user/wearer, such as through an interior window or cutout. Other positions and locations of embellishments are also possible and are not limited to the examples shown herein.

Figure 10A:
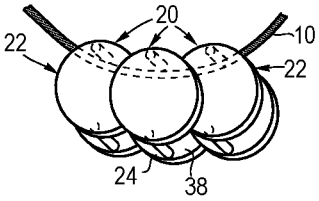
FIGS. 10A-10C are front isometric views of multiple decorative elements or charms of the embodiments of the present disclosure, stacked and mounted together on a single chain, respectively.
Figure 10B:
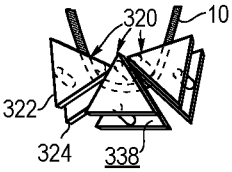
Figure 10C:
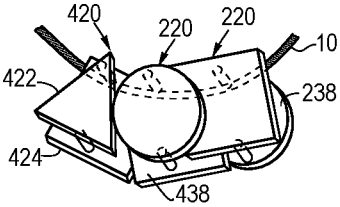

In FIGS. 10A-10C, 11A, 11B, 11C, 12 a plurality of decorative elements may be provided on the chain 10. Where at least two or more decorative elements are used, they may be of the same style, a different style or a combination of same and different styles arranged in different permutations, combinations, arrays or patterns along the chain. By way of example and not limitation, FIG. 10A illustrates three decorative elements 20 according to the embodiment shown in FIG. 5 having circular shapes. FIG. 10B illustrates three decorative elements, generally at 320, including a first and second portions 322, 324 having a triangular shapes attached via supporting members 326, 328 in an upright orientation relative to each other FIG. 10C illustrates a combination of three decorative elements, first and second decorative elements 220 corresponding to that shown in FIGS. 7A-7B, 8C-8D and 9C-9D, with one decorative element being vertically flipped 180 degrees relative to the other, and a third decorative element, generally at 420, including first portion 422 having a triangular shape and a second portion 424 having a square shape.

FIGS. 11A-11B illustrate a yet further combination of the decorative elements 20, 520, 620, in a repeating or alternating pattern, such as represented by a 1-2-1-3-1-2-1 pattern. FIGS. 11A-11B further include a star-shaped decorative element, generally at 520, having first and second portions 522, 524 (where each portion is 6-pointed star shape attached, via supporting members 526, 528, in upright orientation relative to each other) and also a heart-shaped decorative element, generally at 620, having first and second portions 622, 624 (each portion is a heart which is attached, via supporting member 626, 628 in inverted orientation to the other).

As further shown in FIGS. 10A-11B, where at least two or more decorative elements are assembled on the chain, there may be overlap between adjacent decorative members, whereby either one of the first and second portions 22, 24, 222, 224, 322, 324, 422, 424, 522, 524, 622, 624 may overlap into the longitudinal opening 38, 238, 338, 438, 538, 638 of one or both of the adjacent decorative element(s), as shown by the compressed or stacked assembly in FIG. 11B. By way of example, one the first and second portions, such as (left-most) first portion 22 in FIG. 10A, is inserted between the first and second portions 22, 24 of the adjacent (center) decorative element in an overlapping configuration while the (center) first portion 22 also overlaps into the longitudinal opening 38 of the (left most) decorative element. This overlapping configuration allows for relative moving or sliding between adjacent decorative elements allowing independent kinetic movement toward or away from each other and may allow vertical flipping relative to each other or vertical flipping as a subgroup of two or more decorative elements. Where the assembly includes two or more decorative elements, such as shown in FIGS. 10A-11B and 11G, it is possible for some or all adjacent decorative elements to be overlapping. Moreover, as with adjacent overlapping decorative elements, it is possible for either decorative element to be positioned partially in front of the other adjacent member, which is slightly behind it. Alternatively, the overlapping decorative elements may be switched, so that the decorative element that was partially in front is now switched to being partially behind the other, as desired. By way of example, in the overlapping configuration shown in FIG. 11B, the left most circular decorative element 20 is shown partially behind adjacent heart-shaped decorative element 520, but this may be switched so that the circular element 20 is partially in front. Likewise, in FIG. 11B, the heart-shaped decorative element 520 is positioned behind its (rightward) adjacent element 20, which is partially in front, and the star-shaped decorative element 620 is positioned partially behind both (leftward and rightward) adjacent forward elements 20, although these positions may be switched from rear to front or vice versa. It is contemplated that the degree of overlap will depend on the position of the supporting members and that such members may be adjusted to accommodate more or less overlap, as desired. It is also possible that the supporting members may be adjustable or flexible, or attached via flexible materials in an accordion-like attachment, to accommodate more or less stacking of one or more decorative elements, such as a completely or partially nested configuration of elements which may be collapsed or expanded by the user.

Figure 14:
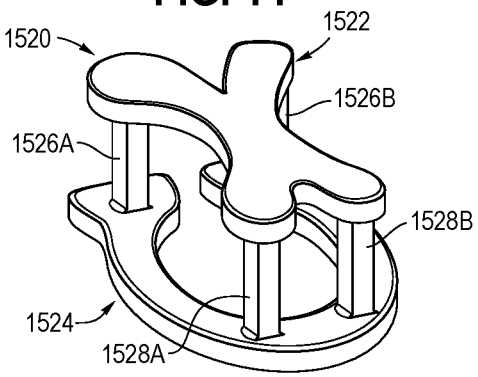
Figure 15:
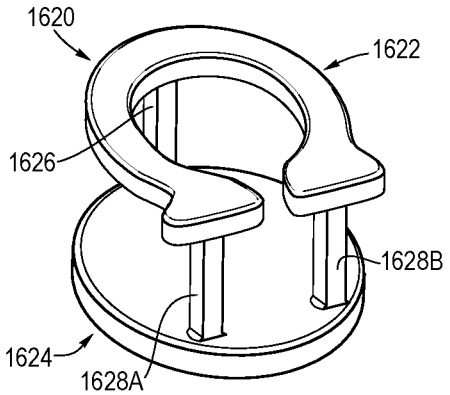
Figure 16:
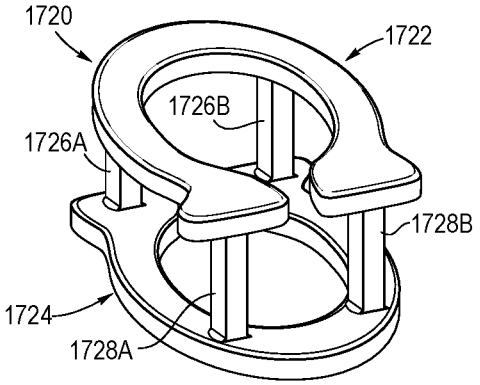
Figure 17A:
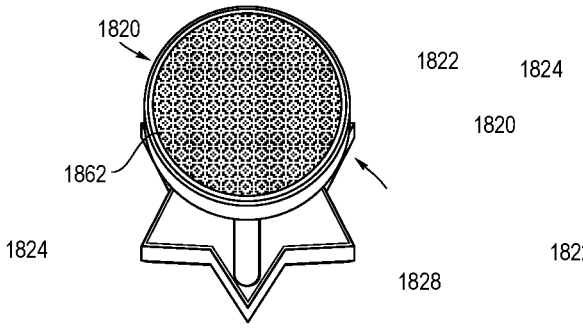
FIGS. 17A-17B illustrate front isometric views of a further decorative element embodiment according to the present disclosure, with FIG. 17A showing a first position and FIG. 17B showing a second position which is vertically flipped from the view shown in FIG. 17A.
Figure 17B:
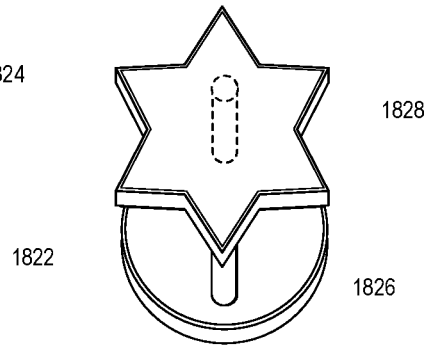
Figure 18A:
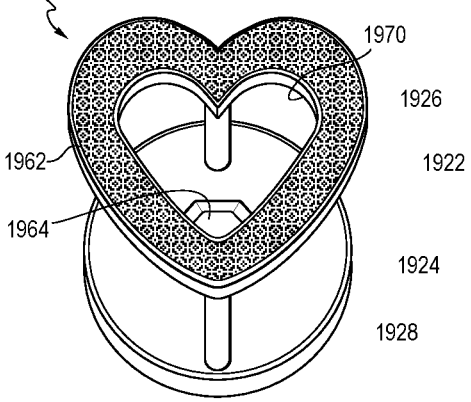
FIGS. 18A-18B illustrate front and rear isometric views of a yet further decorative element embodiment according to the present disclosure, with FIG. 18A showing a first position and FIG. 18B showing the same element, as viewed from the user/wearer direction.
Figure 18B:
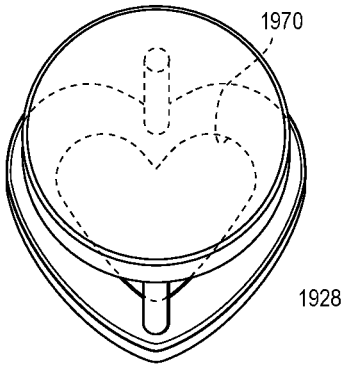
Figure 19A:
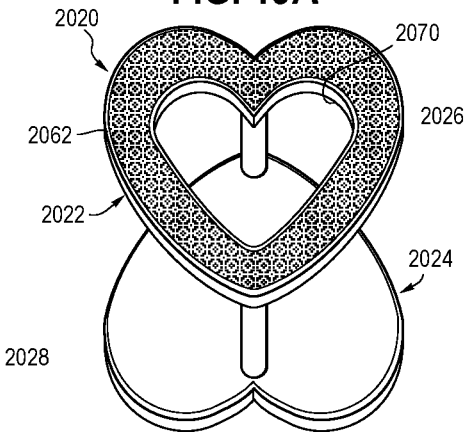
FIG. 19A illustrates a front isometric view of additional decorative element embodiment according to present disclosure.
Figure 20:
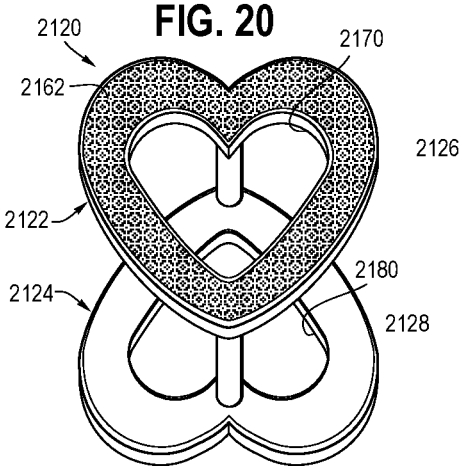
FIG. 20 illustrates a front isometric view of a further decorative element embodiment according to the present disclosure.

In FIGS. 12-16, a further assembly may include decorative elements, generally at 820, 920, 1020, 1120, 1220, 1320, 1420, 1520, 1620, 1720, having at least one or first ornamental surface 830, 930, 1030, 1130, 1230, 1330 representing any of various Greek letter shapes (from left to right as shown) including Delta, Chi, Alpha, Epsilon, Pi, Phi, although other alphanumeric shapes are possible. Other permutations and combinations are also possible and are not limited to the examples shown herein. By way of example, a second ornamental surface (in background of FIG. 12) may be a circular shape, although other shapes are also possible. In FIGS. 13-16, additional decorative element embodiments 1420, 1520, 1620, 1720 are shown having first and second portions 1422, 1424, et seq., each embodiment with like numbered parts, where the portions may be the same shape, by way of example but not limitation a Chi or Omega letter, in either upright or inverted orientation relative to each other (FIGS. 13, 16) or a different shape from each other (FIG. 14-15), combining any two shapes in either upright or inverted orientation relative to each other. These decorative elements may be assembled in a myriad of permutations or combinations thereof on a single chain 10. As shown in FIGS. 14 and 16, an inverted orientation is preferred where at least one shape has horizontal asymmetry, i.e., the top of the shape is different from the bottom. FIGS. 17A-17B, 18A-18B, 19A-20, 21A-21B, 22A-22B and 23 illustrate additional decorative elements 1820, 1920, 2020, 2120, 2320, 2420, again with like numbered parts. With particular attention to FIGS. 18A-18B, 19-20, 22A-22B and 23 , at least one first or second ornamental surfaces has at least one interior window or cutout portion 1970, 2070, 2170, 2180, 2370, 2470, and a plurality of interior windows or cutouts are possible and may vary in size and location on the respective surface to represent any desired shape, letter or letters, configuration, word or words, in any desired format. It is understood that there are numerous possibilities of shapes for the ornamental surfaces apart from the examples provided herein, including but not be limited to alphanumeric characters, such as English letters, Greek letters, as well as numbers, or alphabet letters and/or characters from other languages around the World. In addition, either one or both of the ornamental surfaces may include an entire written phrase, designed in any circumferential shape or outline, such as but not limited to any of the previously described shapes, and further including a plurality of interior windows or cutouts, holes and/or engravings to visually represent a letter, group of letters, words, phrases or sentences, as desired. Symbolic shapes are also possible including but not limited to the Hamsa symbol, shown as decorative element 720, which is a palm-shaped symbol popular in Middle-Eastern and North African culture. Other religious symbols, such as but not limited to the Star of David, shown as decorative elements 620, 1820 (in FIGS. 11A-11C and 17A-17B) are also possible. Other circumferential shapes also are possible such as but not limited to the outline of a child's face, depicting either a boy's or girl's general head shape as well as many other readily identifiable pictorial shapes.

As further shown in FIGS. 12-23, a plurality of supporting members may be used, as shown by way of example with decorative elements 1420, 1520, 1620, 1720, 1820, 1920, 2020, 2120, 2220, 2320 and 2420. The number and positioning of the supporting members will depend on the particular geometry of the ornamental surface, and/or the desired weight balance or structural reinforcement needed. By way of example, in FIGS. 17A-20, two supporting members connect the first and second portions. At least one supporting member is preferably positioned in the proximity of the top of the decorative element, more preferably, near to the top of the decorative element and, even more preferably, at the top most edge of the decorative element. Similarly, at least one support member is preferably positioned in the proximity of the bottom of the decorative element, more preferably, near to the bottom of the decorative element and, even more preferably, at the bottom most edge of the decorative element. Where an embodiment shows a decorative element comprised of two different shapes, and where the height of the shapes may differ, the supporting member preferably extends transversely between the topmost or bottommost common elevation point although other variations in the position of the supporting members are also possible. Moreover, although the supporting members are shown at a position parallel to the transverse axis, it is also possible that the supporting members may extend at an angle or curvature with respect to the transverse axis. In addition, the geometry of any one or more of the supporting members is not limited to the linear geometry shown in the figures and, in fact, the geometry may vary from linear, non-linear, curved or a combination thereof.

The longitudinal opening 38, 138, 238, 338, 438, 538, 638, 738, 838, 938, 1038, 1138, 1238, 1338 preferably has sufficient area to not only receive the chain but to allow for free slidable and rotational movement of the chain and rotation of the decorative element about the longitudinal axis. As shown in FIG. 9E, the longitudinal opening 38 has a depth dimension, coextensive with the supporting members 26, 28, and a height extending between opposed supporting members 26, 28. Preferably, the depth of the opening is less than the height, allowing the decorative element to typically hang vertically from the chain supported by one of the supporting members 26, 28, such as shown in FIG. 9E. By way of example and not limitation, for a 2 mm diameter chain, the depth of the longitudinal opening may be approximately greater than 2 mm, preferably 3.0 or greater, or more preferably 3.5 mm or greater, and a corresponding height that is preferably larger than about 3.5 mm, so that the charm is free to flip horizontally between the first and second ornamental surfaces without obstruction by the opening size. It is understood that other dimensions for the opening are also possible and may be customized to any thickness chain, cord, bangle, bracelet or the like, and thus are not limited to the example provided herein. It further understood that other dimensions for the longitudinal opening are also possible for other chain diameter sizes. The opening is preferably approximately sized sufficiently to accommodate a clasp of the chain to fit therethrough so that the decorative elements may be readily removed and replaced from the chain and/or one or more additional decorative elements may be interchanged or added to the chain in any combination.

Figure 12:
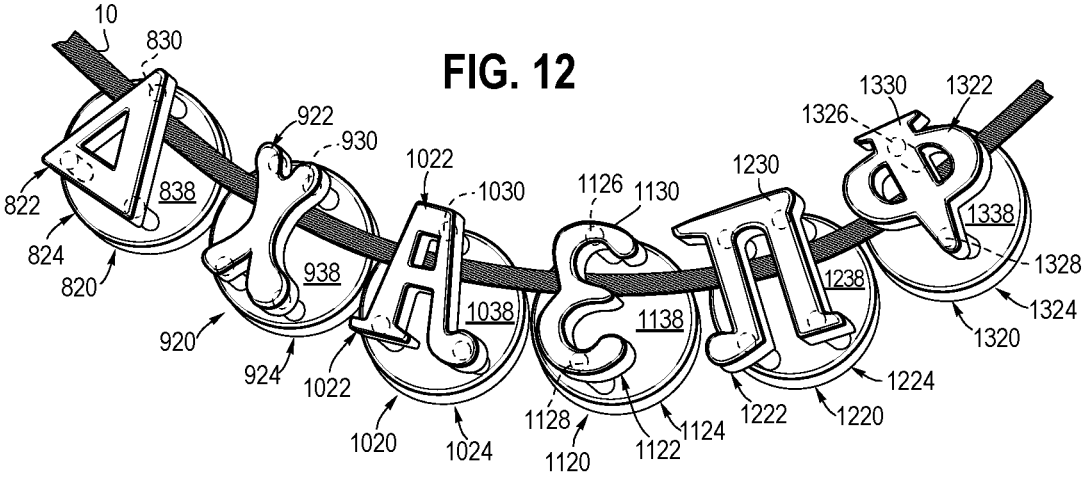
FIG. 12 illustrates an isometric view of a jewelry assembly according to another embodiment of the present disclosure.
Figure 13:
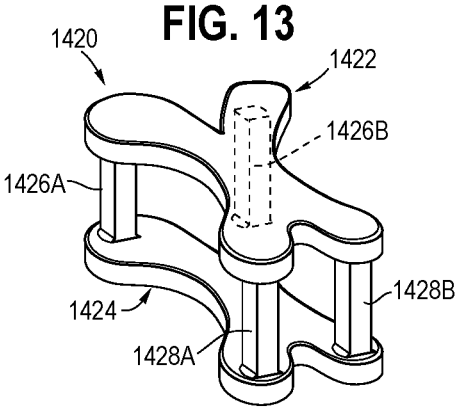
FIGS. 13-16 illustrate isometric views of additional decorative elements according to the present disclosure.

In FIG. 12, the illustrated assembly shows a combination of decorative elements that vary the number of supporting members. In FIG. 12, two supporting members, in accordance with previously described aspects of the present disclosure, are shown for the Greek Letter shapes of Epsilon and Phi. Also in FIG. 12, three supporting members are shown for other Greek letter shapes such as Delta, Alpha, and Pi. Yet further in FIG. 12, four supporting members are shown for additional Greek Letter shapes of Chi, which may also be referred to as an X-shape. As shown in more detail in FIGS. 13-14, the X-shape has supporting members 1426A, 1426B, 1428A, 1428B, 1526A, 1526B, 1528A, 1528B generally positioned at each distal edge of the X-shape. FIGS. 14-16 also show at least one of the first and second portions having another Greek letter shape, specifically an Omega shape 1524, 1622, 1722 which is attached to either a circular-shaped portion 1624, a Chi or X-shaped portion 1522 or other Omega-shaped portion 1624, and which also includes either three or four supporting members 1526A, 1526B, 1528A, 1528B, 1626, 1628A, 1628B, 1726A, 1726B, 1728A, 1728B, as shown. In FIGS. 14-16, the supporting members may extend transversely from free or distal edges of the Omega letter and/or the supporting member 1626 may extend transversely from the curved top edge.

Figure 21A:
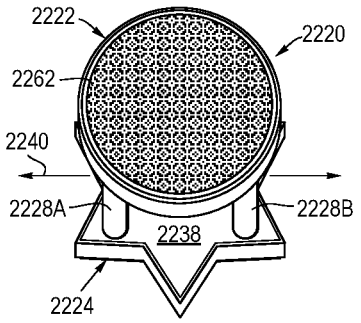
FIGS. 21A-21B illustrate isometric views of a yet further decorative element embodiment according to the present disclosure having up to four supporting members connecting the first and second portions of the decorative element, with FIG. 21A showing a first position and FIG. 21B showing a second position vertically flipped or rotated from the position shown in FIG. 21A.
Figure 21B:
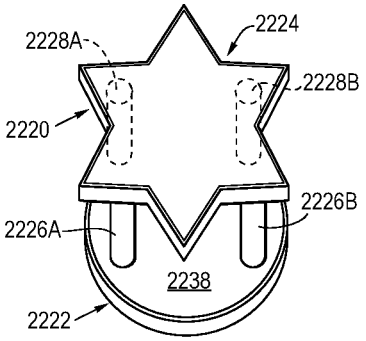

As further shown in FIGS. 21A-21B, the embodiment 2220 illustrates at least four supporting members 2226A, 2226B, 2228A, 2228B that are shown connecting spaced apart first and second portions 2222, 2224 (having a circular shape and star shape respectively) with two supporting members 2226A, 2226B positioned close to the top of the decorative element 2220 and two supporting member 2228A, 2228B positioned close to the bottom. The two upper supporting members 2226A, 2226B are laterally spaced from the two lower supporting members 2228A, 2228B and also on opposed lateral sides of the longitudinal opening 2238, such that the chain may be inserted along the longitudinal axis 2240. The configuration allows vertical flipping of the decorative element by rotation along the longitudinal axis. In accordance with previously discussed aspects of the present disclosure, either the first or second portions 2222, 2224 may include embellishments 2262 and/or one or more interior windows, cutouts or holes representing an overall design representing a desired shapes, letter, letters, words or entire phrases or sentences.

Figure 22A:
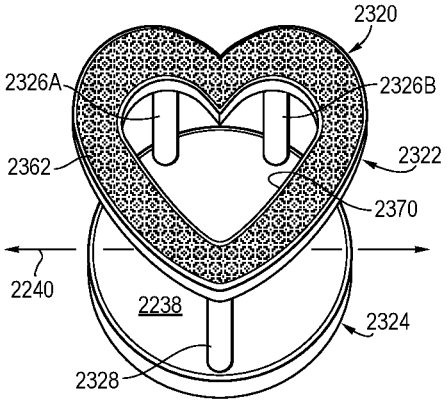
FIGS. 22A-22B illustrate isometric views of a decorative element having up to three supporting members connecting the first and second portions with FIG. 22A showing a first position and FIG. 22B showing a second position vertically flipped relative to FIG. 22A.
Figure 22B:
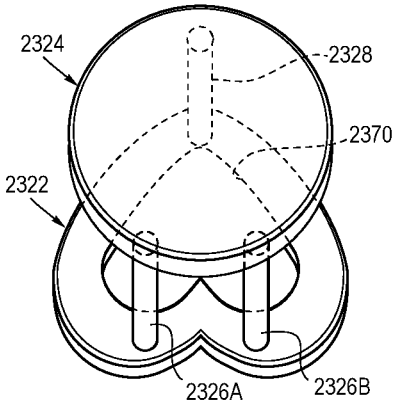
Figure 23:
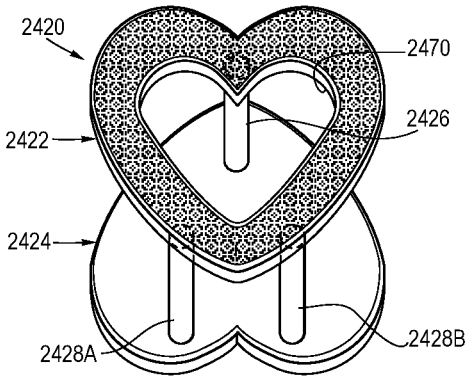
FIG. 23 illustrate a front isometric view of a decorative element according to another embodiment of the present disclosure having up to three supporting members connecting the first and second portions.

In FIGS. 22A-22B, another decorative element 2320 shows at least three supporting members 2326A, 2326B, 2328, connecting first and second portions 2322, 2324, (having a heart outline with a heart shaped window/cutout 2370 and a circular shape, respectively) with two members 2326A, 2326B positioned at the top most elevation of the decorative element in FIG. 22A and one 2328 positioned at the bottom most elevation. FIG. 22B shows the decorative element of FIG. 22A after rotation about the axis 2240 approximately 180 degrees. FIG. 23 similarly shows at least three supporting members 2426, 2428A, 2428B with a first heart shape portion 2422 attached to an inverted heart shape for the second (rear) portion 2424. As accordance with previously described aspects of the present disclosure, when the decorative element 2420 is rotated or vertically flipped, approximately 180 degrees, about the longitudinal axis, the rear positioned portion 2424 is switched to an upright and front position whereby the front heart cutout portion 2422 is switched to a rear and inverted position.

As should be understood, the decorative elements 20, et seq., may be designed in different sizes and shapes and incorporated into any form of jewelry such as necklaces, bracelets, anklets or other types of jewelry. The chain may be rigid or flexible and made of various interlocking materials including metal or plastic or can be replaced with a cord or string. The material of the decorative elements may also be varied among metal, including but not limited to semi-precious metal, metal alloys, wood, plastic, polymers, clay, ceramics, any composite material including any of the foregoing or any combination thereof. Any of the decorative elements may also have any type of jewel, stone or other indicia 62, et seq., engraved, attached, embedded, or connected via solder, adhesive or other conventional methods, preferably but not exclusively, on or into the ornamental surfaces 30, 32, et seq., or on any location of the ornamental surface or any location around the window portion 1962, 2062, 2162, 2362, 2462. In addition, any embellishment, monogram or engraving, stamp or gemstone, such as illustrated at 1964 in FIG. 18A, may be included on any of the inwardly facing surfaces, preferably where it is effectively facing outwardly and viewable through a cutout or other window portion.

It will be appreciated by those skilled in the art that changes could be made to the embodiment(s) described above without departing from the broad inventive concept thereof. It is understood, therefore, that this disclosure is not limited to the particular embodiments disclosed, but it is intended to include modifications within the spirit and scope of the disclosure.

The invention claimed is:

1. A jewelry apparatus wearable by a user comprising:

a jewelry chain;

a decorative element having a longitudinal opening disposed along a longitudinal axis for slidably receiving the chain, the decorative element comprising:

a first portion having a first ornamental surface and a first opposing surface which is opposed to the first ornamental surface;

a second portion having a second ornamental surface and a second opposing surface which is opposed to the second ornamental surface, the second portion being transversely spaced in relation to the first portion on opposed sides of the longitudinal opening and wherein the first ornamental surface and the second ornamental surface are disposed in opposed outwardly facing directions relative to each other along a transverse axis that is perpendicular to the longitudinal axis; and at least two supporting members transversely extending between the first portion and the second portion and connecting therebetween, a first supporting member and a second supporting member being disposed on opposed sides of the longitudinal opening, perpendicular to each of the first and second portions; and wherein the decorative element is free to rotate about the longitudinal axis between a first position, in which the decorative element is suspended on the chain by said first supporting member and the first ornamental surface faces outwardly from the user when worn by the user, and a second position in which the decorative element is suspended on the chain by said second supporting member and the second ornamental surface faces outwardly from the user when worn by the user.

2. The jewelry apparatus of claim 1 wherein each of the first and second supporting member has a first end and a second end, the first end being attached to the first portion and the second end being attached to the second portion.

3. The jewelry apparatus of claim 1 wherein, in the first position, the first supporting member is located adjacent the chain.

4. The jewelry apparatus of claim 1 wherein, in the second position, the second supporting member is located adjacent the chain.

5. The jewelry apparatus of claim 1 wherein, in the first position, the first portion faces outwardly from the user in an upright configuration and, when rotated to the second position, the first portion faces the user in an inverted configuration.

6. The jewelry apparatus of claim 1 wherein, in the first position, the second portion faces the user in an inverted configuration and, when rotated to the second position, the second portion faces outwardly in an upright configuration.

7. The jewelry apparatus of claim 1 including at least three supporting members.

8. The jewelry apparatus of claim 1 including at least four supporting members.

9. The jewelry apparatus of claim 1 including a plurality of decorative elements.

10. The jewelry apparatus of claim 9 wherein the plurality of decorative elements overlap each other along the longitudinal axis.

11. The jewelry apparatus of claim 1 wherein the first and second opposing surfaces are disposed in facing relation to each other on opposing sides of the longitudinal opening.

12. The jewelry apparatus of claim 1 wherein the second position is 180 degrees of rotation from the first position about the longitudinal axis.

13. The jewelry apparatus of claim 1 wherein the second ornamental surface faces the user when in the first position and the first ornamental surface faces the user when in the second position.

14. The jewelry apparatus of claim 1 wherein at least one of the first and second portions is a shape selected from a circle, a square, a heart, a triangle, and a star.

15. The jewelry apparatus of claim 14 wherein the shape includes an outline surrounding at least one interior window.

16. The jewelry apparatus of claim 1 wherein at least one of the first and second portions forms an alphanumeric shape.

17. The jewelry apparatus of claim 16 wherein at least one of the first and second portions is a shape selected from a Greek Letter.

18. The jewelry apparatus of claim 16 wherein the other of the first and second portions is a shape selected from a circle, a square, a heart, a triangle, and a star.

19. The jewelry apparatus of claim 1 wherein at least one of the first and second ornamental surfaces includes at least one jewel attached thereto.

20. The jewelry apparatus of claim 1 wherein at least one of the first and second ornamental surfaces includes an engraving applied thereto.

* * * * *